US009969579B2

(12) United States Patent
Yamabe et al.

(10) Patent No.: US 9,969,579 B2
(45) Date of Patent: May 15, 2018

(54) SHEET CONVEYANCE APPARATUS AND IMAGE FORMING APPARATUS

(71) Applicant: CANON KABUSHIKI KAISHA, Tokyo (JP)

(72) Inventors: Daisuke Yamabe, Toride (JP); Hisanori Iwasaki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/444,533

(22) Filed: Feb. 28, 2017

(65) Prior Publication Data

US 2017/0269532 A1 Sep. 21, 2017

(30) Foreign Application Priority Data

Mar. 18, 2016 (JP) ..... 2016-056231

(51) Int. Cl.
*B65H 5/06* (2006.01)
*G03G 21/16* (2006.01)

(52) U.S. Cl.
CPC ..... *B65H 5/062* (2013.01); *G03G 21/1633* (2013.01); *B65H 2402/441* (2013.01); *B65H 2402/45* (2013.01)

(58) Field of Classification Search
CPC ..... B65H 5/062; B65H 2402/31; B65H 2402/35; B65H 2402/40; B65H 2402/441; B65H 2402/45; B65H 2404/1421; B65H 2404/144; B65H 2404/152; B65H 2404/1521; G03G 21/1633
See application file for complete search history.

(56) References Cited

U.S. PATENT DOCUMENTS 6,794,633 B2 9/2004 Iwasaki
2013/0108320 A1* 5/2013 Ju ..... G03G 15/0189 399/121

FOREIGN PATENT DOCUMENTS

JP 05-213476 A 8/1993

* cited by examiner

*Primary Examiner* — Michael C McCullough
(74) *Attorney, Agent, or Firm* — Fitzpatrick, Cella, Harper & Scinto

(57) ABSTRACT

A sheet conveyance apparatus includes first and second conveyance rollers, a holding member configured to rotatably hold the second conveyance roller, and an urging member to urge the holding member in a pressing direction. In addition, a reduction portion reduces a force applied to an openable member by the urging member when the openable member is opened or closed. The reduction portion includes a swingable member swingably supported by the openable member and movable to a first position, at which the swingable member causes the second conveyance roller to be pressed against the first conveyance roller, and a second position at which the swingable member causes the second conveyance roller to be separated from the first conveyance roller. The urging member is disposed between the swingable member and the holding member and urges the swingable member to swing toward an abut portion.

17 Claims, 5 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus and an image forming apparatus, and particularly to a configuration thereof for reducing an operational force for opening or closing an opening/closing member.

Description of the Related Art

Conventionally, an image forming apparatus such as a printer, a copier, or a printer includes a sheet conveyance apparatus that conveys a sheet by using a conveyance roller pair provided in a sheet conveyance path. The sheet conveyance apparatus includes a door serving as an opening/closing member that is opened to remove a jammed sheet in the case where, for example, a sheet is jammed in the sheet conveyance path.

An example of such a sheet conveyance apparatus is configured such that, to facilitate removal of the jammed sheet, one of the conveyance roller pair serving as a driven roller is provided in the door and is separated from the other of the conveyance roller pair serving as a driving roller when the door is opened. When the removal of the jammed sheet is finished and the door is closed, the driven roller abuts the driving roller.

An example of a conventional sheet conveyance apparatus includes a sheet conveyance path defined by a fixed guide plate and a movable guide plate. In the example of the conventional sheet conveyance apparatus, the driven roller and an elastic member for pressing the driven roller against the driving roller are attached to the movable guide plate. For example, Japanese Patent Laid-Open No. 5-213476 discloses a sheet conveyance apparatus including a link member swingably provided between a movable guide plate and an upper side cover serving as the door such that the driven roller abuts the driving roller in accordance with a closing operation of the door.

In this sheet conveyance apparatus, when the upper side cover is closed, the movable guide plate is pressed via the elastic member by a pressurizing arm serving as the link member and held at a position to define the sheet conveyance path and press the driven roller against the driving roller. When the upper side cover is opened, the pressure applied by the pressurizing arm is released, the movable guide plate is elastically moved in a direction to move away from the fixed guide plate together with the upper side cover, and thus the driven roller is separated from the driving roller. When the opened upper side cover is closed, the closing operation of the upper side cover is conveyed to the movable guide plate via the pressurizing arm, and thus the movable guide plate is moved toward the fixed guide plate and the driven roller is pressed against the driving roller.

In a conventional sheet conveyance apparatus, in the case where, for example, the driven roller is provided at a position away from an opening/closing center of the opening/closing member, the opening/closing member opens with a great force due to a repulsive force of the elastic member when opening the opening/closing member. To prevent this, the opening/closing member requires to be opened against the elastic force of the elastic member. In addition, when closing the opening/closing member, the opening/closing member requires to be closed against the elastic force of the elastic member. As described above, in the case where the elastic member is provided, an operational force required to open or close the opening/closing member becomes larger, and thus the operability thereof decreases.

SUMMARY OF THE INVENTION

An aspect of the present invention provides a sheet conveyance apparatus including an openable member provided to an apparatus body, a conveyance roller pair comprising a first conveyance roller provided in the apparatus body and a second conveyance roller configured to come into pressure contact with the first conveyance roller, a holding member configured to rotatably hold the second conveyance roller and slidable in a pressing direction in which the second conveyance roller is pressed against the first conveyance roller, an urging member configured to urge the holding member in the pressing direction, and a reduction portion configured to reduce a force applied to the openable member by the urging member when the openable member is opened or closed. The reduction portion includes a swingable member swingably supported by the openable member and movable to a first position and a second position, the first position being a position of the swingable member at which the swingable member causes the second conveyance roller to be pressed against the first conveyance roller, the second position being a position of the swingable member at which the swingable member causes the second conveyance roller to be separated from the first conveyance roller, wherein the urging member is disposed between the swingable member and the holding member, and an abut portion which is provided in the apparatus body and against which the swingable member abuts such that the swingable member is separable from the abut portion. The swingable member is, in a case of closing the openable member, caused to abut the abut portion and move to a first position along with a movement of the openable member in a closing direction while compressing the urging member, and, in a case of opening the openable member, caused to move to a second position along with a movement of the openable member in an opening direction while abutting the abut portion.

Another aspect of the present invention provides a sheet conveyance apparatus including an openable member provided to an apparatus body, a first conveyance roller provided in the apparatus body, a second conveyance roller provided in the openable member and configured to come into pressure contact with the first conveyance roller, an urging member provided in the openable member and configured to urge the second conveyance roller toward the first conveyance roller, a movable member movably supported by the openable member, wherein the urging member is disposed between the movable member and the second conveyance roller, and an abut portion which is provided in the apparatus body and against which the movable member abuts. The abut portion moves the movable member along with a movement of the openable member in a closing direction such that the urging member urges the second conveyance roller toward the first conveyance roller.

Further features of the present invention will become apparent from the following description of exemplary embodiments with reference to the attached drawings.

DESCRIPTION OF THE EMBODIMENTS

An exemplary embodiment of the present invention will be described below in detail with reference to drawings. To be noted, up-down and right-left directions indicated by arrows in drawings universally represent identical directions in all drawings, and the direction perpendicular to the sheet surface of this document corresponds to a front-rear direction of an apparatus.

Figure 1:
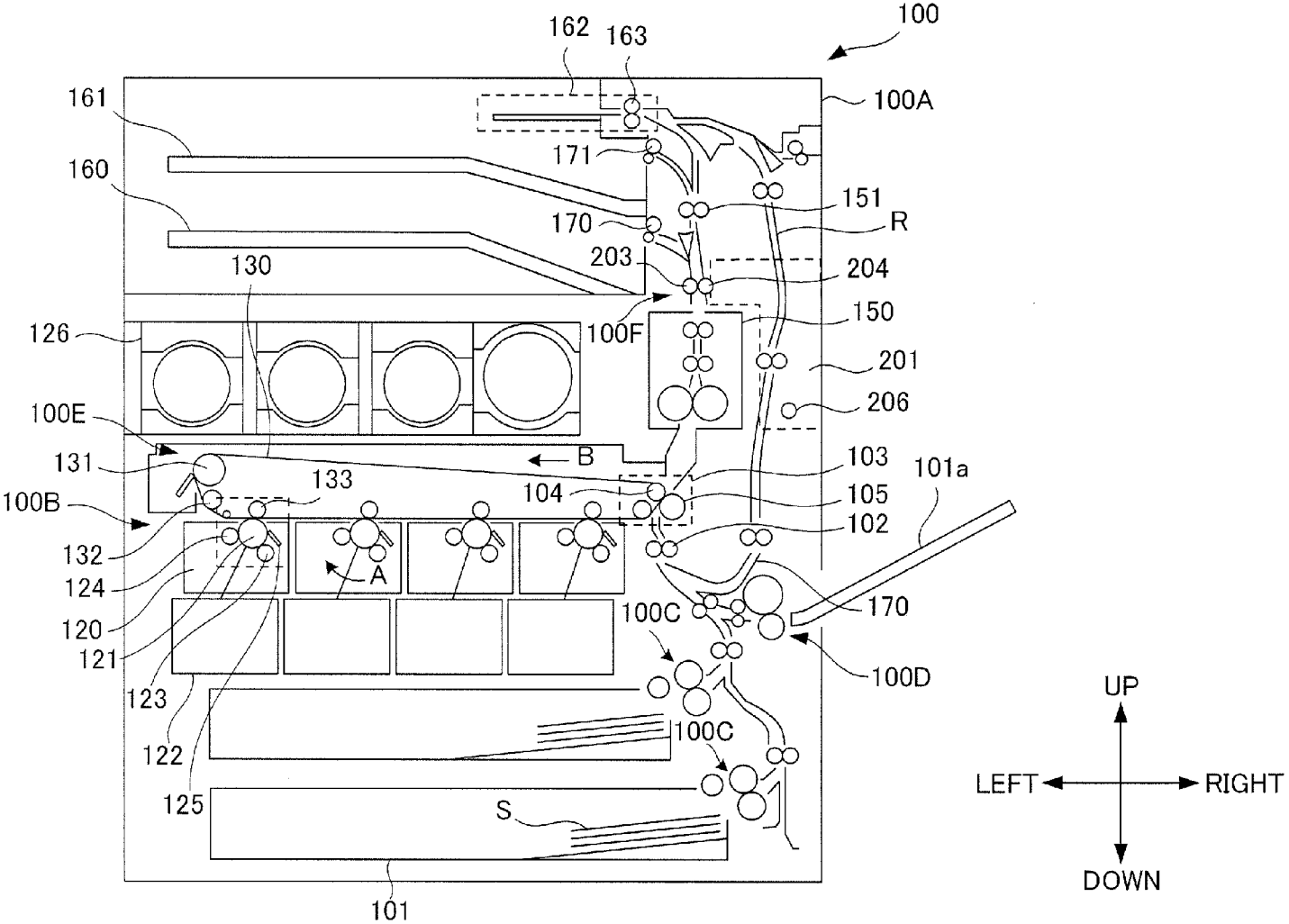
FIG. 1 schematically illustrates a configuration of a full-color laser beam printer serving as an example of an image forming apparatus including a sheet conveyance apparatus according to an exemplary embodiment of the present invention.

FIG. 1 schematically illustrates a configuration of a full-color laser beam printer serving as an image forming apparatus of the present embodiment. Arrows in FIG. 1 indicate up-down and right-left directions with respect to the full-color laser beam printer viewed from the front, and the direction perpendicular to the sheet surface of this document corresponds to a front-rear direction of the full-color laser beam printer. The full-color laser beam printer will be hereinafter referred to as a printer. To be noted, arrows in the other drawings indicate the same up-down and right-left directions.

As illustrated in FIG. 1, a printer body 100A serving as an image forming apparatus body of a printer 100 includes an image forming portion 100B configured to form an image on a sheet. In addition, the printer body 100A includes a sheet feed portion 100C, a manual sheet feed portion 100D, and a sheet conveyance apparatus 100F. The sheet feed portion 100C feeds a sheet S from a sheet feed cassette 101 accommodating the sheet S, the manual sheet feed portion 100D feeds a sheet S placed on a manual feed tray 101*a*, and the sheet conveyance apparatus 100F conveys the sheet S.

The image forming portion 100B employs a four-drum full-color system, and includes laser scanners 122 and four process cartridges 120. The process cartridges respectively form toner images of four colors of yellow, magenta, cyan, and black, and correspondence thereof to these colors will be respectively denoted by letters of Y, M, C, and K. Here, the process cartridges 120 each includes a photosensitive drum 121, an electrifier 123 serving as an electrification portion, a developing portion 124, and a cleaner 125. In addition, the image forming portion 100B includes an intermediate transfer unit 100E and toner cartridges 126 disposed above the process cartridges 120.

The intermediate transfer unit 100E includes an intermediate transfer belt 130 looped over a driving roller 131, a tension roller 132, and a secondary transfer inner roller 104. The intermediate transfer unit 100E further includes primary transfer rollers 133 that are each disposed in a space enclosed by the intermediate transfer belt 130 and each abut the intermediate transfer belt 130 at a position opposing a corresponding photosensitive drum 121. The intermediate transfer belt 130 is rotated in an arrow B direction by the driving roller 131 driven by a driving portion that is not illustrated. Toner images of respective colors negatively electrified on photosensitive drums 121 are sequentially transferred by the primary transfer rollers 133 onto the intermediate transfer belt 130 so as to be superimposed on one another.

A secondary transfer roller 105 is disposed in the intermediate transfer unit 100E at a position opposing the secondary transfer inner roller 104. The secondary transfer roller 105 is configured to transfer a color image formed on the intermediate transfer belt 130 onto the sheet S. The secondary transfer inner roller 104 and the secondary transfer roller 105 constitute a secondary transfer portion 103.

Further, a fixing portion 150 is disposed above the secondary transfer roller 105, and a first discharge roller pair 170, a second discharge roller pair 171, and a sheet inversion portion 162 are disposed to the upper left of the fixing portion 150. The sheet inversion portion 162 includes an inversion roller pair 163, a re-conveyance path R, and so forth. The inversion roller pair 163 is capable of rotating in a normal direction and in a reverse direction, and a sheet S bearing an image formed on one surface thereof is conveyed again to the image forming portion 100B through the re-conveyance path R. The sheet conveyance apparatus 100F includes a pair of conveyance rollers 203 and 204, and a conveyance roller pair 151 for conveying the sheet S bearing an image fixed thereonto to the first discharge roller pair 170, the second discharge roller pair 171, or the inversion roller pair 163.

Next, an image forming operation of the printer 100 will be described. At the start of the image forming operation, an image signal is input to the laser scanners 122 from a personal computer or the like that is not illustrated, and laser light corresponding to the image signal is radiated from the laser scanners 122 onto the photosensitive drums 121 of respective process cartridges 120. At this time, the surface of each of the photosensitive drums 121 has been uniformly electrified to a predetermined polarity and potential by the electrifier 123, and an electrostatic latent image is formed on the surface due to the laser light radiated thereonto from a corresponding laser scanner 122.

After this, the electrostatic latent images are developed by the developing portions 124, and thereby toner images of four colors of yellow, magenta, cyan, and black are formed on the photosensitive drums 121 of the respective process cartridges 120. Then, the toner images of four colors are sequentially transferred onto the intermediate transfer belt 130 due to a primary transfer bias applied to the primary transfer rollers 133, and thereby a full-color toner image is formed on the intermediate transfer belt 130. Toner remaining on the surface of the photosensitive drums 121 after transfer of the toner images is removed by the cleaners 125.

In parallel with this operation of forming the toner image, the sheet S accommodated in the sheet feed cassette 101 is delivered out by the sheet feed portion 100C and conveyed to a registration roller pair 102, and the skew thereof is corrected. In the case of manual sheet feeding, the sheet S placed on the manual feed tray 101*a* is delivered out by the manual sheet feed portion 100D, and then conveyed to the registration roller pair 102. After the skew has been corrected, the sheet S is conveyed to the secondary transfer portion 103 by the registration roller pair 102 so as to match with a timing of a conveyance of the image to the secondary transfer portion 103. Then, at the secondary transfer portion 103, the full-color toner image on the intermediate transfer belt 130 is transferred onto the sheet S by applying a bias with a positive polarity to the secondary transfer roller 105.

After the toner image has been transferred, the sheet S is conveyed to the fixing portion 150, and, at the fixing portion 150, heat and pressure are applied to the sheet S to fix the toner image to the surface of the sheet S. Then, the sheet S bearing the toner image fixed thereto is discharged onto a first sheet discharge tray 160 by the first discharge roller pair 170 or onto a second sheet discharge tray 161 by the second discharge roller pair 171. The first discharge roller pair 170 and the second discharge roller pair 171 are both disposed downstream of the fixing portion 150. In the case of forming images on both surfaces of the sheet S, the sheet S is conveyed to the re-conveyance path R by the inversion roller pair 163 after an image is fixed onto one surface of the sheet S, and is then conveyed to the image forming portion 100B again.

As illustrated in FIG. 1, the pair of conveyance rollers 203 and 204 is constituted by a conveyance roller 203 and a driven roller 204. In addition, a door 201 serving as an openable member to be opened in the case where jamming of a sheet or the like occurs is provided on one side, right side in FIG. 1, of the printer body 100A also serving as an apparatus body of the sheet conveyance apparatus 100F. The door 201 is provided so as to be openable and closable by pivoting about an opening/closing shaft 206 serving as a pivot center (a swing center).

Figure 2:
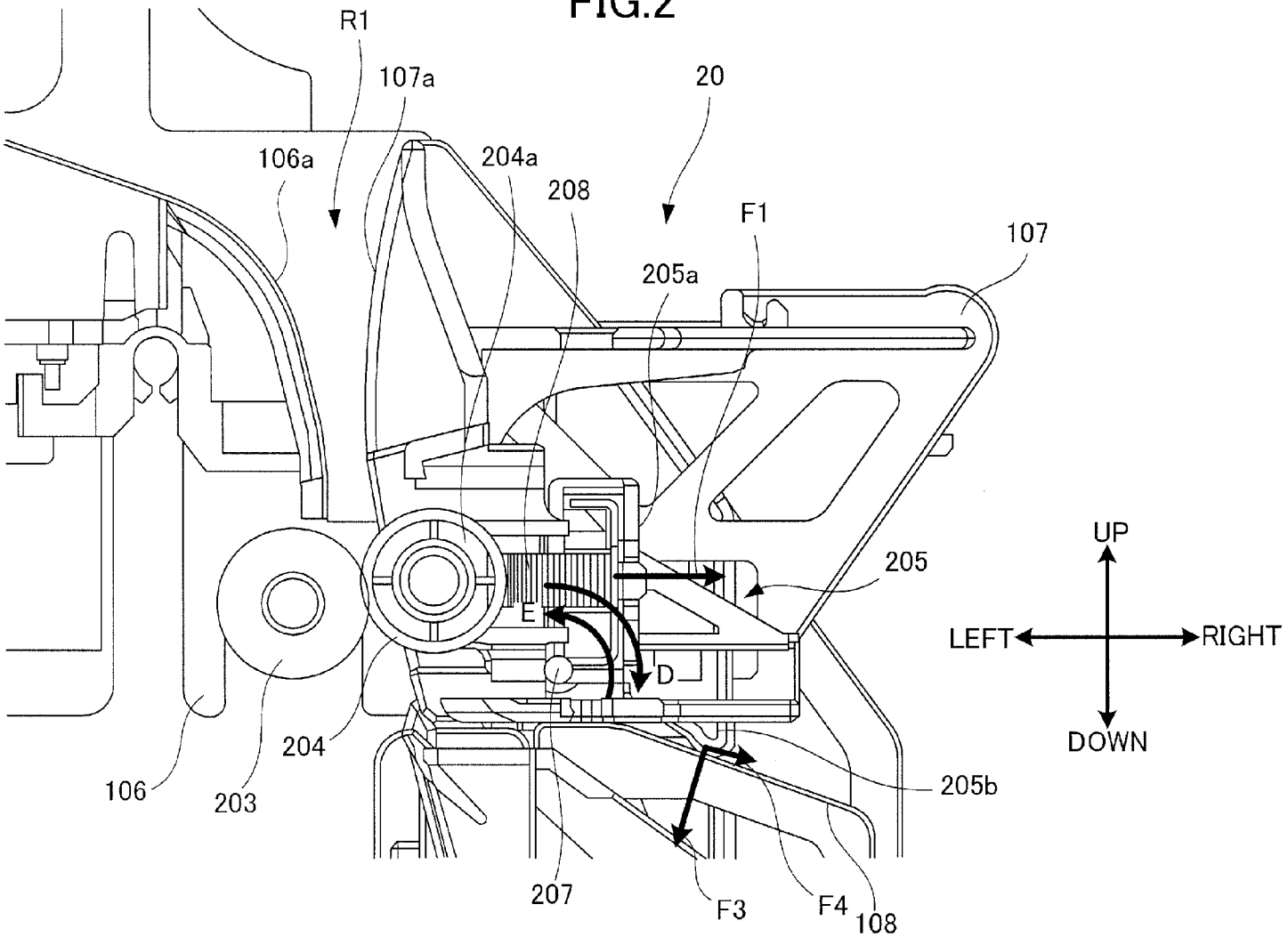
FIG. 2 is an enlarged view of a part of the full-color laser beam printer.

Here, as illustrated in FIG. 2, the conveyance roller 203 serving as a first conveyance roller is rotatably attached to a fixed guide member 106 provided in the printer body 100A. The driven roller 204 serving as a second conveyance roller is rotatably supported by a movable guide member 107 attached to the door 201 described above and illustrated in FIG. 1. The fixed guide member 106 and the movable guide member 107, which moves together with the door 201, define a sheet conveyance path R1 through which the sheet S passes.

The driven roller 204 is rotatably supported by a bearing 204*a* provided on the movable guide member 107 so as to be slidable in a pressing direction in which the driven roller 204 is pressed against the conveyance roller 203. The bearing 204*a* serving as a holding member that rotatably holds the driven roller 204 is urged toward the conveyance roller 203 by a pressurizing spring 208 serving as an urging member, and thus the driven roller 204 projects from a side surface 107*a* of the movable guide member 107 on the fixed guide member 106 side.

In the case where the door 201 is closed, the driven roller 204 urged by the pressurizing spring 208 is pressed against the conveyance roller 203 while compressing the pressurizing spring 208. In this case, the side surface 107*a* of the movable guide member on the fixed guide member 106 side and a side surface 106*a* of the fixed guide member 106 on the movable guide member 107 side define the sheet conveyance path R1 trough which the sheet S bearing an image fixed thereto passes.

The movable guide member 107 is provided with a pressurizing link 205 attached thereto serving as a swingable member supported so as to be swingable about a swing shaft 207. In addition, the printer body 100A includes an abut portion 108 that the pressurizing link 205 separably abuts.

The pressurizing link 205 includes a first arm 205*a* and a second arm 205*b*, and the swing shaft 207 is disposed between the first arm 205*a* and the second arm 205*b*. The pressurizing spring 208 is disposed between the first arm 205*a* and the bearing 204*a*. That is, the first arm 205*a* engages with the pressurizing spring 208 configured to urge the driven roller 204 toward the conveyance roller 203. The second arm 205*b* abuts the abut portion 108 when the pressurizing link 205 swings clockwise.

FIG. 2 illustrates a state in which the door 201 is closed. In this state, the driven roller 204 urged by the compressed pressurizing spring 208 via the bearing 204*a* is pressed against the conveyance roller 203. The position of the pressurizing link 205 at which the pressurizing link 205 causes the pressurizing spring 208 to be compressed (deformed) and the driven roller 204 to come into pressure contact with the conveyance roller 203 via the bearing 204*a* will be referred to as a first position. In addition, the pressurizing spring 208 applies a repulsive force F1 to the first arm 205*a* of the pressurizing link 205, and the repulsive force F1 causes the pressurizing link 205 to swing clockwise about the swing shaft 207. Thus, the second arm 205*b* of the pressurizing link 205 is in pressure contact with the abut portion 108 with a repulsive force F3. It is noted that a direction in which the abut portion 108 receives a restoring force of the spring 208 from the movable member 205, i.e., a direction of the repulsive force F3, intersects a direction in which the openable member 201 moves while the spring 208 is deformed.

Figure 3:
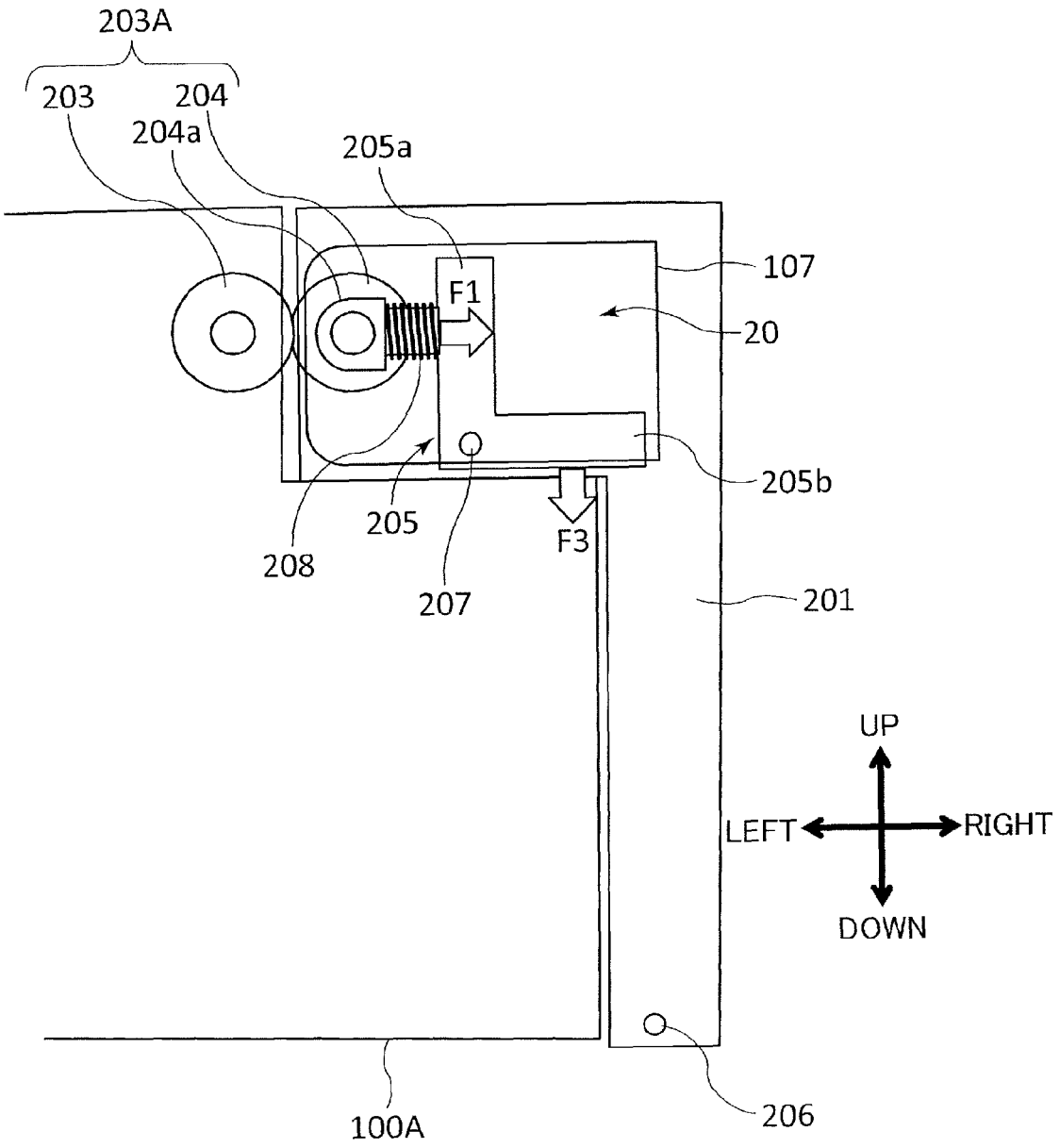
FIG. 3 is a schematic view illustrating an operation of a door-operation force reduction portion provided in the full-color laser beam printer.

As described above, in the present exemplary embodiment, the pressurizing link 205 is caused to swing to be in pressure contact with the abut portion 108 by the repulsive force F1 of the compressed pressurizing spring 208 when the door 201 is closed. That is, in the present exemplary embodiment, the pressurizing link 205 is pressed against the abut portion 108 by converting the repulsive force F1 of the pressurizing spring 208 into the repulsive force F3, which is the swinging force about the swing shaft 207, as illustrated in FIG. 3. In other words, the abut portion 108 moves the movable member 205 along with a movement of the openable member 201 in a closing direction such that the urging member 208 urges the second conveyance roller 204 toward the first conveyance roller 203. This causes the repulsive force F1 of the pressurizing spring 208 to be applied to the printer body 100A, specifically to the abut portion 108, when the door 201 is closed, and thus reduces the magnitude of the repulsive force F1 of the pressurizing spring 208 applied to the door 201.

As described above, when the door 201 is closed, the magnitude of the repulsive force F1 of the pressurizing spring 208 applied to the door 201 is reduced by the pressurizing link 205 and the abut portion 108. Thus, in the present exemplary embodiment, a door-operation force reduction portion 20 configured to reduce the operational force of the door 201 is constituted by the pressurizing link 205 and the abut portion 108.

Figure 4:
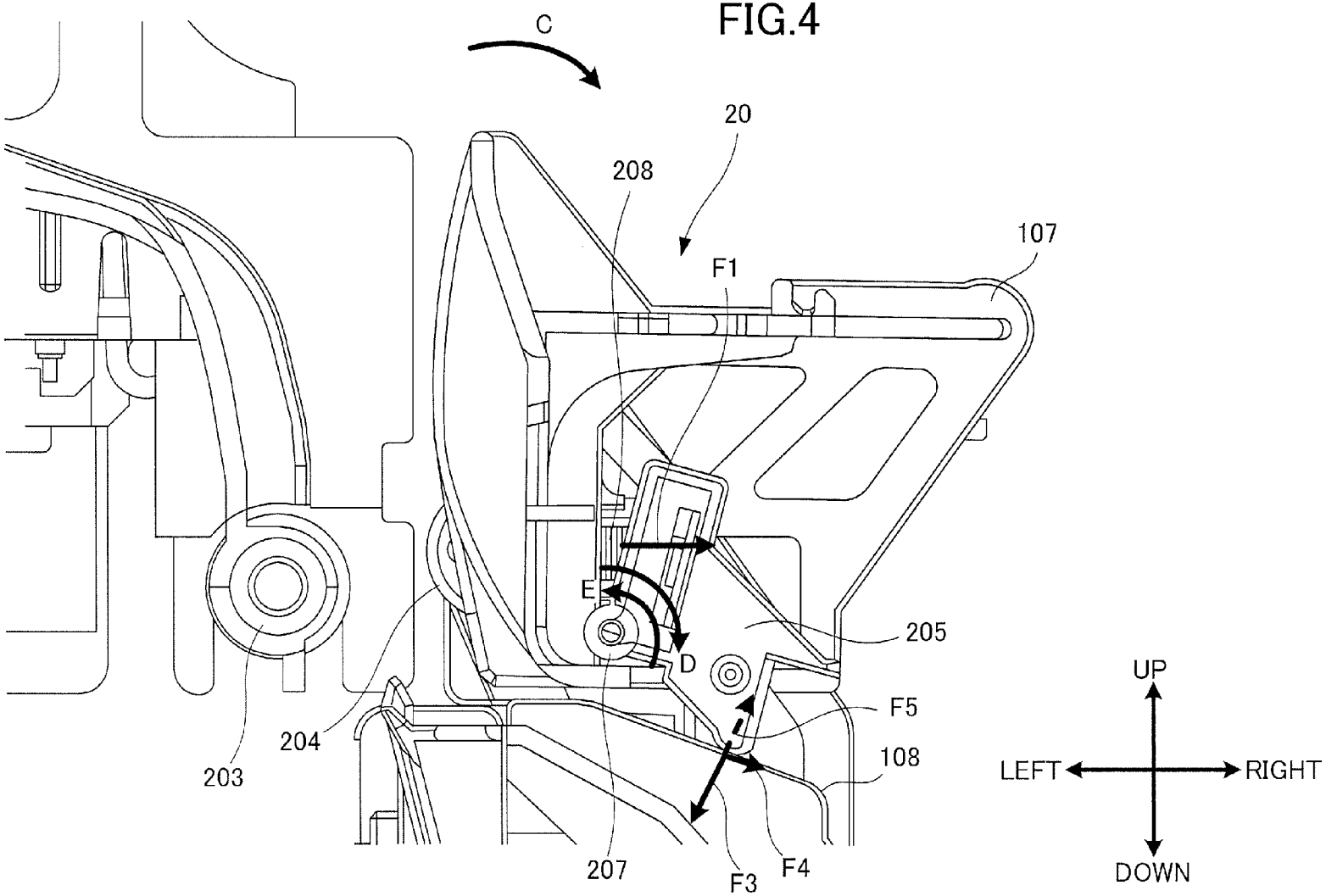
FIG. 4 illustrates a state of the door-operation force reduction portion when a door is opened.

Next, the operational force for opening the door 201 that is closed will be described. When the door 201 is closed, the repulsive force F1 of the pressurizing spring 208 is mainly applied to the abut portion 108 as illustrated in FIG. 2 that has been already described. In the case where the door 201 is opened by 1° as illustrated in FIG. 4 by cancelling locking of a locking portion that is provided in the printer body 100A and not illustrated, the movable guide member 107 moves, in an opening direction indicated by an arrow C, integrally with the door 201 along with the movement of the door 201 in the opening direction.

Along with this movement of the movable guide member 107, a pressure contact position of the second arm 205*b* of the pressurizing link 205 and the abut portion 108 moves downstream in the opening direction. Here, the abut portion 108 is inclined such that a more downstream portion thereof in the opening direction is lower, and thus the pressurizing link 205 swings in a direction indicated by an arrow D due to the repulsive force F1 of the compressed pressurizing spring 208 that is released when the pressure contact position moves.

As a result of this, the movable guide member 107 moves, with the second arm 205*b* of the pressurizing link 205 kept in pressure contact with the abut portion 108, to the second position at which the driven roller 204 is separated from the conveyance roller 203. At this time, a frictional force F4 is generated between the second arm 205*b* of the pressurizing link 205 and the abut portion 108 due to the repulsive force F3, and therefore the magnitude of the repulsive force F1 of the pressurizing spring 208 applied to the door 201 when opening the door 201 is reduced. As a result of this, a large force can be prevented from being applied to the door 201 due to the repulsive force F1 of the pressurizing spring 208 when opening the door 201, and thus the operational force for opening the door 201 can be reduced.

In the case where the door 201 is opened further after this, the contact between the second arm 205*b* and the abut portion 108 is cancelled, and the pressurizing link 205 abuts a stopper that is provided on the movable guide member 107 and not illustrated to be held at a predetermined swing position.

Next, the operational force for closing the door 201 that is open will be described. When a closing operation of the door 201 is performed, the second arm 205*b* of the pressurizing link 205 that has moved to the predetermined swing position abuts the abut portion 108. Then, in the case where the door 201 is closed further, a repulsive force F5 is applied from the abut portion 108 to the pressurizing link 205 in an opposite direction to F3 as illustrated in FIG. 4 along with the movement of the door 201 in a closing direction.

In the case where the repulsive force F5 is applied to the pressurizing link 205, the pressurizing link 205 swings in an arrow E direction while compressing the pressurizing spring 208. That is, when a closing operation of the door 201 is performed, the repulsive force F5 applied from the abut portion 108 causes the pressurizing link 205 to swing in the arrow E direction while compressing the pressurizing spring 208. As a result of this, the pressurizing link 205 moves to the first position. The driven roller 204 comes into contact with the conveyance roller 203 while the pressurizing link 205 is compressing the pressurizing spring 208 and swinging in the arrow E direction. The pressurizing link 205 keeps on compressing the pressurizing spring 208 and swinging in the arrow E direction after the driven roller 204 comes into contact with the conveyance roller 203.

Thus, as a result of employing a configuration in which the pressurizing link 205 is caused to swing by the repulsive force F5 from the abut portion 108 when the pressurizing link 205 abuts the abut portion 108, the force for causing the pressurizing link 205 to swing is applied from the printer body 100A when a closing operation of the door 201 is performed. In accordance with this, the magnitude of the repulsive force F1 of the pressurizing spring 208 applied to the door 201 is reduced. That is, when performing a closing operation of the door 201, the magnitude of the repulsive force F1 of the pressurizing spring 208 applied to the door 201 is reduced by the pressurizing link 205 and the abut portion 108. This reduces the operational force for closing the door 201.

As described above, in the present exemplary embodiment, the pressurizing link 205 is moved to the first position while abutting the abut portion 108 along with the movement of the door 201 in the closing direction when closing the door 201. In addition, the pressurizing link 205 is moved to the second position while abutting the abut portion 108 along with the movement of the door 201 in the opening direction when opening the door 201.

This causes the force applied by the pressurizing spring 208 to be received by the printer body 100A when opening or closing the door 201, and thus the force that the door 201 receives is reduced. This reduces the operational force for opening or closing the door 201. As a result of this, the door 201 can be opened or closed without lowering the operability.

Figure 5:
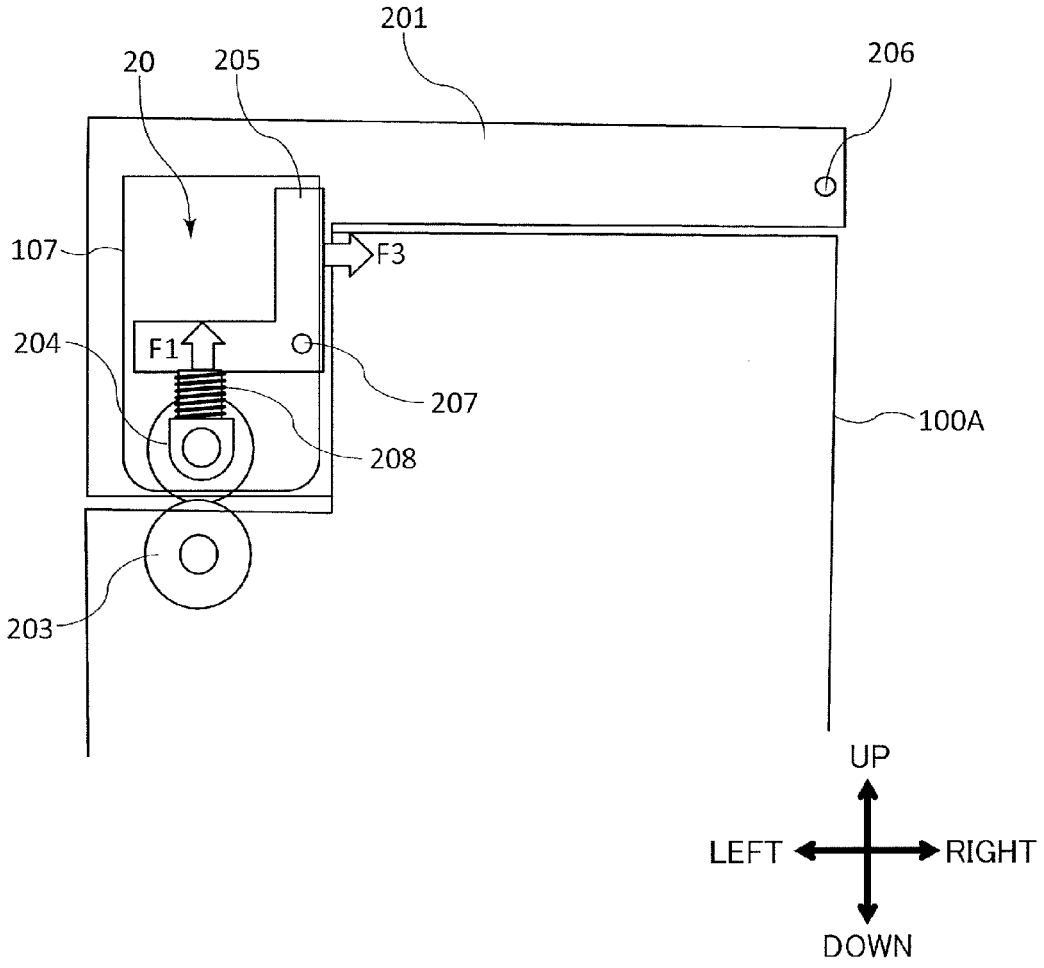
FIG. 5 illustrates another example of the door-operation force reduction portion.

In the description above, a printer including the door 201 on one side, right side in the exemplary embodiment, of the printer body 100A has been described. However, aspects of the present invention are not limited to this embodiment. For example, the present invention may be applied to a printer in which the door 201 is provided on the top surface of the printer body 100A so as to be openable and closable as illustrated in FIG. 5.

In addition, a case where the movable guide member 107 is integrally provided on the door 201 has been described above. However, aspects of the present invention are not limited to this embodiment. The movable guide member 107 may be swingably provided in the printer body 100A and may be movable together with the door 201 when opening or closing the door 201.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-056231, filed Mar. 18, 2016, which is hereby incorporated by reference wherein in its entirety.

What is claimed is:

1. A sheet conveyance apparatus comprising:

an openable member provided on an apparatus body;

a conveyance roller pair comprising a first conveyance roller provided in the apparatus body and a second conveyance roller configured to come into pressure contact with the first conveyance roller;

a holding member configured to rotatably hold the second conveyance roller and slidable in a pressing direction in which the second conveyance roller is pressed against the first conveyance roller;

an urging member configured to urge the holding member in the pressing direction; and a reduction portion configured to reduce a force applied to the openable member by the urging member when the openable member is opened or closed, wherein the reduction portion comprises a swingable member swingably supported by the openable member and movable to a first position and a second position, the first position being a position at which the swingable member causes the second conveyance roller to be pressed against the first conveyance roller, and the second position being a position at which the swingable member causes the second conveyance roller to be separated from the first conveyance roller, and an abut portion which is provided in the apparatus body and against which the swingable member abuts, wherein the urging member is disposed between the swingable member and the holding member and configured to urge the swingable member to swing toward the abut portion, and wherein the swingable member, in a case of closing the openable member, abuts the abut portion and moves to the first position along with movement of the openable member in a closing direction while compressing the urging member and, in a case of opening the openable member, moves to the second position along with movement of the openable member in an opening direction while abutting the abut portion.

2. The sheet conveyance apparatus according to claim 1, wherein the swingable member comprises a first arm and a second arm which is formed integrally with the first arm as a single piece, wherein the urging member is disposed between the holding member and the first arm, and wherein the second arm is configured to abut the abut portion.

3. The sheet conveyance apparatus according to claim 1, further comprising:

a fixed guide member provided in the apparatus body; and a movable guide member configured to move along with opening of the openable member, wherein the fixed guide member and the movable guide member define a sheet conveyance path in which the conveyance roller pair is provided.

4. The sheet conveyance apparatus according to claim 3, wherein the movable guide member is attached to the openable member in an integral manner.

5. The sheet conveyance apparatus according to claim 3, wherein the second conveyance roller and the holding member are provided on the movable guide member.

6. The sheet conveyance apparatus according to claim 1, wherein the openable member is openable and closable with respect to the apparatus body by pivoting about a pivot center.

7. An image forming apparatus comprising:

an image forming portion; and the sheet conveyance apparatus according to claim 1.

8. A sheet conveyance apparatus comprising:

an openable member provided on an apparatus body;

a first conveyance roller provided in the apparatus body;

a second conveyance roller provided in the openable member and configured to come into pressure contact with the first conveyance roller;

an urging member provided in the openable member and configured to urge the second conveyance roller toward the first conveyance roller;

a movable member supported by the openable member so as to be swingable with respect to the openable member around a swing center; and an abut portion which is provided in the apparatus body and against which the movable member abuts, wherein the urging member is disposed between the second conveyance roller and the movable member so that the movable member receives a repulsive force from the urging member urging the second conveyance roller into press-contact with the first conveyance roller, the repulsive force acting on the movable member in such a manner that the movable member is urged toward the abut portion in a first direction about the swing center, and the abut portion causes the movable member to swing in a second direction opposite to the first direction about the swing center when the openable member is being closed.

9. The sheet conveyance apparatus according to claim 8, wherein the movable member comprises a first arm configured to engage with the urging member and a second arm integrally formed with the first arm and configured to abut the abut portion, and wherein the movable member is supported by the openable member such that the movable member is swingable about the swing center disposed between the first arm and the second arm.

10. The sheet conveyance apparatus according to claim 8, wherein the openable member is openable and closable with respect to the apparatus body by pivoting about a pivot center.

11. The sheet conveyance apparatus according to claim 8, wherein the urging member is a spring, and wherein the movable member is configured to, while the movable member is in contact with the abut portion, move with respect to the openable member along with the movement of the openable member in a closing direction such that the spring is deformed.

12. The sheet conveyance apparatus according to claim 11, wherein the abut portion receives a restoring force of the spring via the movable member in a case where the openable member is closed.

13. The sheet conveyance apparatus according to claim 12, wherein a direction in which the abut portion receives the restoring force from the movable member intersects a direction in which the openable member moves while the spring is deformed.

14. An image forming apparatus comprising:

an image forming portion; and the sheet conveyance apparatus according to claim 8.

15. The sheet conveyance apparatus according to claim 8, wherein the urging member comprises an elastic member, and the elastic member can be deformed by the abut portion making the movable member swing in the second direction along a closing operation of the openable member after contact of the second conveyance roller with the first conveyance roller, and the second conveyance roller is brought into press contact with the first conveyance roller by a restoring force of the elastic member.

16. The sheet conveyance apparatus according to claim 8, wherein the urging member comprises an elastic member, the elastic member can be deformed by the abut portion making the movable member swing in the second direction along a closing operation of the openable member in a state where the second conveyance roller contacts with the first conveyance roller and the movable member contacts with the abut portion, and the second conveyance roller is brought into press contact with the first conveyance roller by a restoring force of the elastic member.

17. The sheet conveyance apparatus according to claim 8, wherein the urging member comprises an elastic member, the sheet conveyance apparatus further comprising a holding member configured to rotatably hold the second conveyance roller, with the holding member being movably provided in the openable member, wherein one end of the elastic member is connected to the holding member and other end of the elastic member is connected to the movable member.

* * * * *